US005839603A

United States Patent [19]

Smith et al.

[11] Patent Number: 5,839,603

[45] Date of Patent: Nov. 24, 1998

[54] LIGHTWEIGHT PEEL-TOP CAN LID

[75] Inventors: Robert J. Smith, Edinboro; Jay C. Fidorra, Erie, both of Pa.

[73] Assignee: Erie County Plastics Corporation, Corry, Pa.

[21] Appl. No.: 927,714

[22] Filed: Sep. 11, 1997

Related U.S. Application Data

[60] Provisional application No. 60/085,944 Sep. 11, 1996.

[51] Int. Cl.[6] ..... B65D 41/16

[52] U.S. Cl. ..... 220/782; 220/380

[58] Field of Search ..... 220/780, 781, 220/782, 380, 376, 305; 206/508, 509, 511; 215/230

[56] References Cited

U.S. PATENT DOCUMENTS

| | | | |
|---|---|---|---|
| 2,097,173 | 10/1937 | Bazeley | 220/305 |
| 3,133,666 | 5/1964 | Henchert | 220/782 |
| 3,179,283 | 4/1965 | Amberg | 220/380 X |
| 3,367,665 | 2/1968 | Gorman . | |
| 3,531,013 | 9/1970 | Hammes . | |
| 3,557,995 | 1/1971 | MacEwen | 220/380 X |
| 3,567,016 | 3/1971 | Bardell . | |
| 3,679,088 | 7/1972 | Swett et al. . | |
| 3,679,089 | 7/1972 | Swett et al. . | |
| 3,843,016 | 10/1974 | Bornhorst et al. . | |
| 3,931,890 | 1/1976 | Davis | 220/380 X |
| 4,117,950 | 10/1978 | Allen . | |
| 4,640,435 | 2/1987 | Dutt | 220/782 X |
| 5,033,633 | 7/1991 | Heilman | 215/230 X |
| 5,119,962 | 6/1992 | Vercillo et al. | 215/230 |
| 5,398,908 | 3/1995 | Kienle | 220/376 X |

*Primary Examiner*—Stephen K. Cronin
*Assistant Examiner*—Nathan Newhouse
*Attorney, Agent, or Firm*—Webb Ziesenheim Bruening Logsdon Orkin & Hanson, P.C.

[57] ABSTRACT

The present invention provides a peel-top flexible plastic closure to be formed by injection molding. The closure of the present invention is of reduced weight by incorporating a plurality of tapered-wall sections about the top surface of the closure. The closure of the present invention can be manufactured utilizing an injection mold having a single center gate.

20 Claims, 5 Drawing Sheets

LIGHTWEIGHT PEEL-TOP CAN LID

LIGHTWEIGHT PEEL-TOP CAN LID

This Application claims the benefit of U.S. provisional application Ser. No. 60/025,944 entitled "Lightweight Peel-Top Can Lid" filed Sep. 11, 1996.

BACKGROUND OF THE INVENTION

1. Field of the Invention

The present invention relates to a molded plastic container closure; it more specifically relates to a lightweight peel-top closure, such as a can lid.

2. Prior Art

Container closures formed from molded plastic and having a top surface extending across the area bounded by a peripheral rim are well-known in the prior art. Examples of such plastic closures are shown in U.S. Pat. Nos. 3,531,013; 3,567,016; 3,679,089; 3,679,088; and 3,843,016. Additionally, attempts have been made to reduce the amount of plastic used in the production of conventional closures such as described in U.S. Pat. No. 4,117,950 to Allen. The Allen patent attempts to minimize plastic material used in forming the top or center panel by incorporating a plurality of equally spaced rod-like ribs with thin-walled panel members positioned between pairs of radially extending ribs. The Allen patent discloses a particular molding technique in which the thin panel members between the ribs are formed with plastic flowing from the ribs generally transverse to the length of the ribs.

It is the object of the present invention to provide a new design for a lightweight peel-top injection-molded container closure. It is the further object of the present invention to provide a lightweight closure design which is easily manufactured in a cost-effective manner.

SUMMARY OF THE INVENTION

The objects of the present invention are achieved by providing a flexible, one-piece injection-molded plastic closure having a circular outer rim structure and a center panel enclosed by the rim structure. The center panel of the present invention includes a plurality of substantially sector-shaped sections having uniform thickness throughout, and a plurality of tapered, substantially sector-shaped sections positioned between the uniform thickness sections. The tapered sections may taper towards the center of the center panel.

In one embodiment of the present invention, the center panel may be provided with a circular center-gate section from which the plurality of uniform thickness and tapered sector-shaped sections extend. The sector-shaped sections can extend from the center-gate section to substantially the rim structure.

In a specific embodiment of the present invention, the sectors of uniform thickness may have a wall thickness of about 0.018" with the tapered sections being tapered from a thickness of about 0.006" adjacent the center-gate section to a thickness of 0.18" at the outer peripheral portion of the tapered section near the rim portion. The circular center-gate section may be formed to a uniform thickness of about 0.024". In this embodiment of the present invention, nine uniform thickness sectors are provisioned equally spaced about the top portion, each uniform thickness sector formed of an arc of about 25°. In this embodiment, nine tapered sectors are provided, with each tapered sector formed of an arc of about 50° and positioned between the adjacent uniform thickness sectors.

The rim structure of the peel-top closure of the present invention may include a downwardly extending flange extending from a bottom surface of the center panel with a locking projection extending radially inwardly on a lower portion of the flange, the locking projection being formed by two opposed ramp-like surfaces extending from the flange. In one embodiment of the present invention the upper surface of the top member is substantially planar although extending to an upwardly extending peripheral lip adjacent the rim structure.

These and other advantages of the present invention will be clarified in the description of the preferred embodiment taken together with the attached drawings wherein like reference numerals represent like elements throughout.

BRIEF DESCRIPTION OF THE PREFERRED EMBODIMENT

FIGS. 1–7 illustrate a lightweight peel-top container closure 10 according to the present invention which is manufactured in one piece from a suitable thermoplastic material preferably by injection-molding. In general, low-density or linear low-density polyethylene will be utilized to form the closure 10 of the present invention. However, high-density polyethylene may be utilized for more rigid applications. Additionally, various styrene and other plastic compositions may also be utilized.

The closure 10 is formed of an outer peripheral rim structure 12 and a top center panel 14 enclosed by and connected to the rim structure 12. As shown in FIGS. 2 and 3 and FIGS. 6 and 7, the top surface of the center panel 14 is substantially planar extending up to an upwardly extending peripheral lip 16 adjacent the rim structure 12. The peripheral lip 16 extends from an upper surface of the center panel 14.

Figure 6:
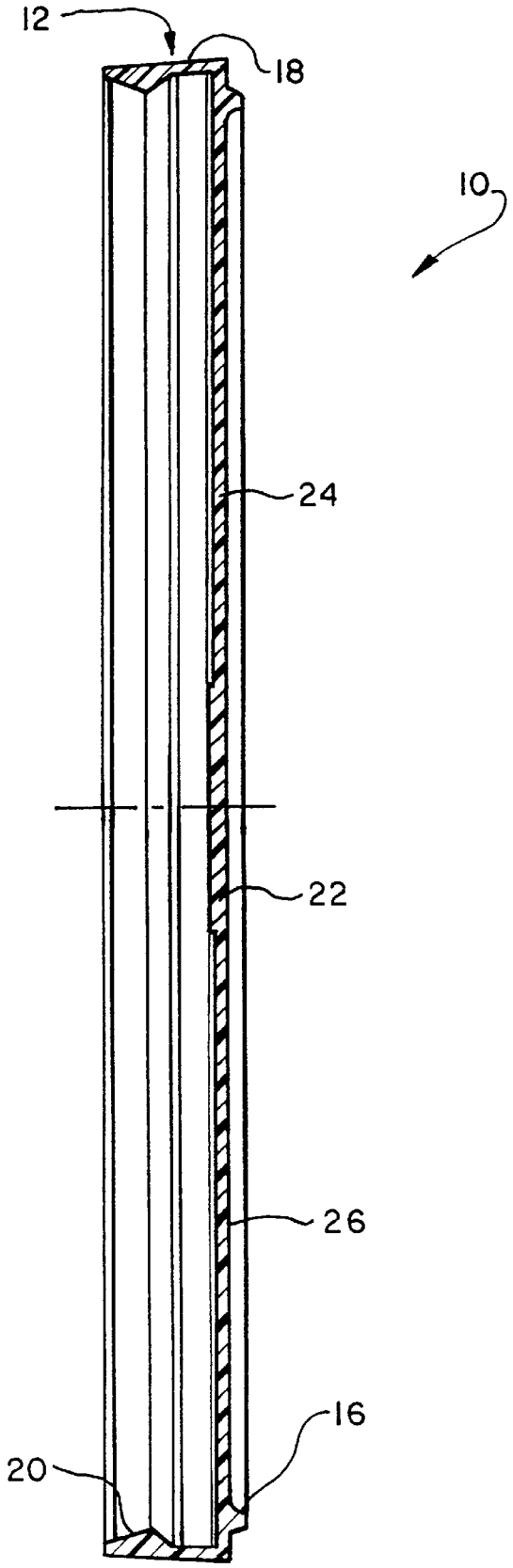
FIG. 6 is a sectional view of the peel-top closure illustrated in FIGS. 1–5 taken along section line A—A in FIG. 3.
Figure 7:
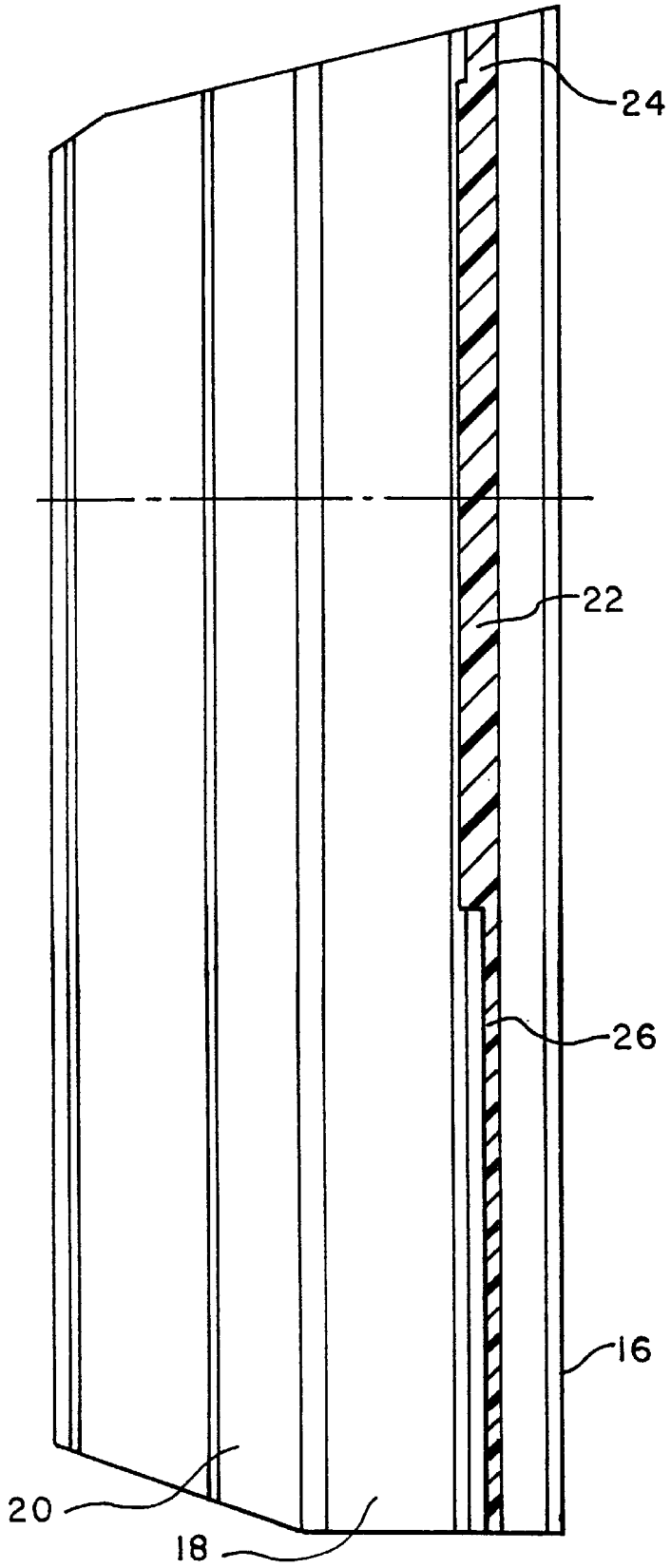
FIG. 7 is an enlarged sectional view of a portion of a section illustrated in FIG. 6.

The rim structure 12, best illustrated in FIG. 6, includes a circular flange 18 extending substantially perpendicular to the center panel 14 from a lower surface of the center panel 14. The flange 18 is positioned around the peripheral edge of the center panel 14. The flange 18 includes an inwardly extending locking projection 20 which is utilized to secure the closure 10 beneath a corresponding rim or lip of a container. The locking projection 20 is formed by two angled ramp surfaces extending away from the flange 18. The ramp surfaces forming the locking projection 20 assist in the application or removal of the closure 10. The closure 10 is applied in the conventional press-fit manner, the locking projection 20 snapping underneath the corresponding lip or rim of the container. To remove the closure 10, one portion of the rim structure 12 is grasped manually by the user and peeled away from the container and the remaining portions of the closure 10 peeled from the corresponding container, as is well-known in the art.

The center panel 14 of the present invention has been specifically designed to utilize a minimum amount of plastic material to provide a significant cost savings in the production of the closure 10.

Figure 1:
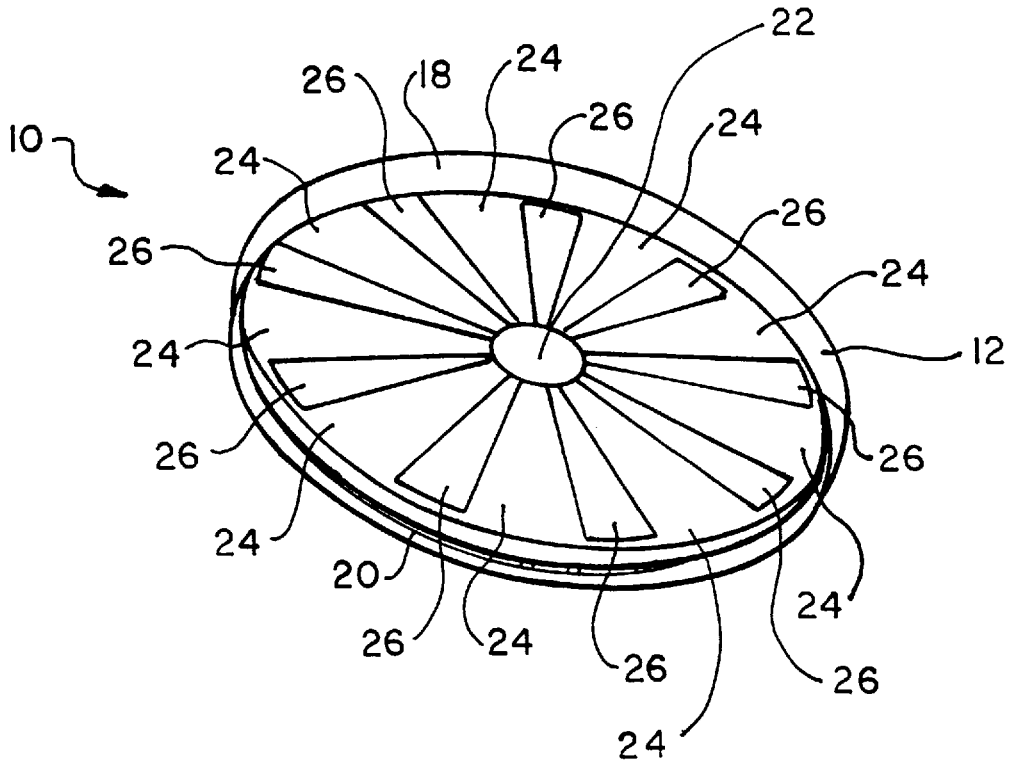
FIG. 1 is a perspective view showing a lower surface of the peel-top closure according to the present invention.
Figure 2:
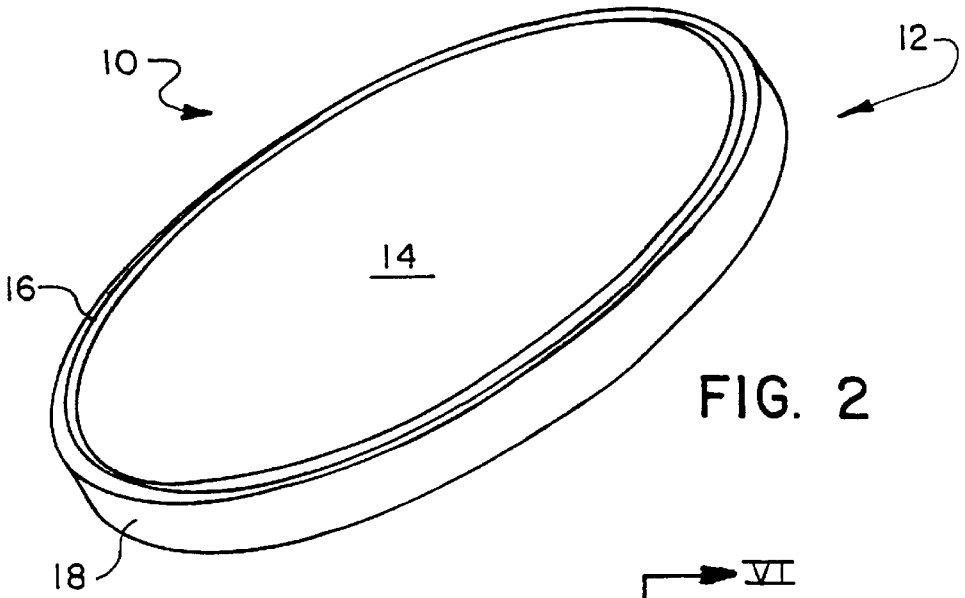
FIG. 2 is a perspective view illustrating the upper surface of the peel-top closure according to the present invention.
Figure 3:
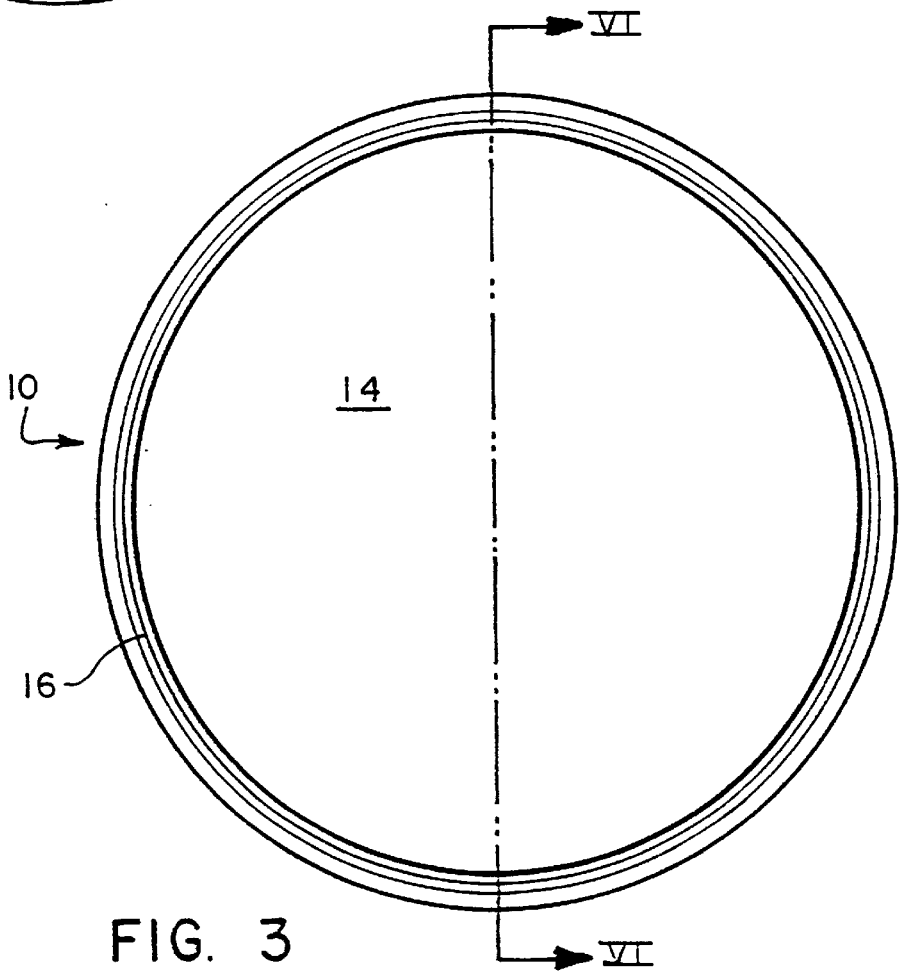
FIG. 3 is a top-plan view of the peel-top closure illustrated in FIGS. 1 and 2.
Figure 4:
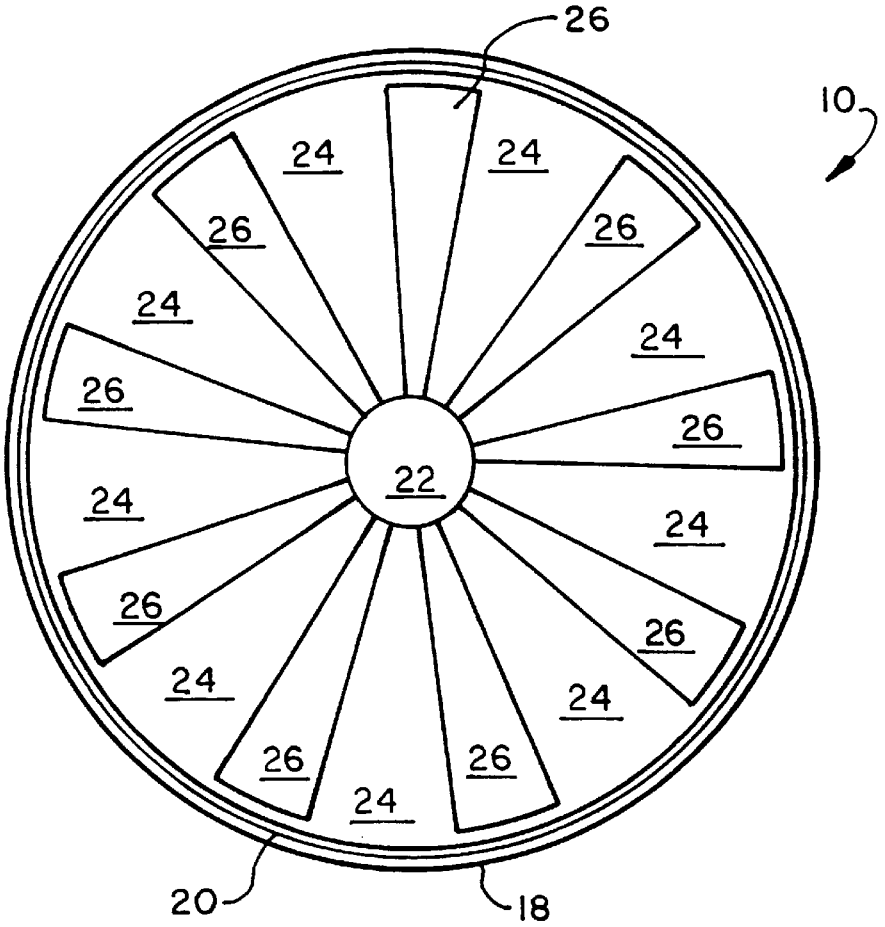
FIG. 4 is a bottom-plan view of the peel-top closure illustrated in FIGS. 1–3.
Figure 5:
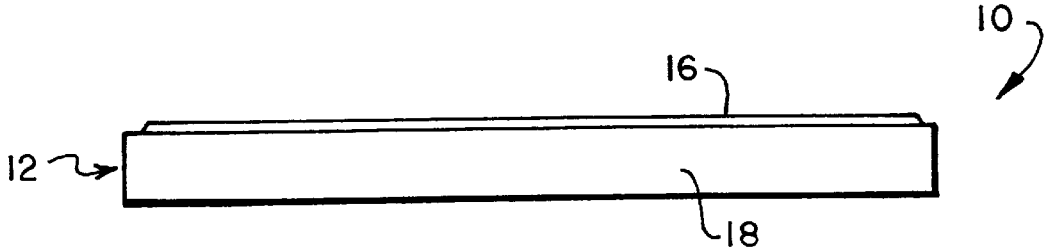
FIG. 5 is a side view of the peel-top closure illustrated in FIGS. 1–4.

As shown in FIGS. 1 and 4, the center panel 14 is formed of a substantially circular center-gate section 22 with a plurality of substantially sector-shaped sections extending from the center-gate section 22 to the rim structure 14. The center panel 14 includes a plurality of equally spaced sector-shaped sections 24, each section 24 having a substantially uniform thickness throughout, and a plurality of tapered sector-shaped sections 26 positioned between the uniform thickness sections 24. The tapered sections 26 are tapered towards the center of the center panel 14 from a minimum thickness of about 0.06" to a thickness equivalent to the thickness of the uniform thickness sections 24.

The advantages of the closure 10 of the present invention can be further highlighted by reviewing a specific example of a closure 10 made according to the present invention. The closure 10 illustrated in FIGS. 1–7 has an outside diameter of about 3.134". The center-gate section 22 has a uniform thickness of about 0.024" and a diameter of about 0.500". Each uniform thickness sector-shaped section 24 has a thickness of about 0.018" and forms an arc of about 25° on the center panel 14. Each tapered section 26 extends from a minimum thickness of about 0.006" adjacent the center gate 22 to about 0.018" thick adjacent the rim structure 12. The flange 18 extends about 0.259" down from the center panel 14.

The closure 10 according to the present invention reduces the weight of the closure 10 by using the tapered sections 26 which are spaced around the center panel 14. The manufacture of the closure 10 utilizes a single center gate centered on the center-gate section 22. The thinnest section of the tapered section 26 is closest to the center gate allowing this thin area to fill first when the melt temperature of the plastic is the hottest. As the flow front advances, the cooler temperature of the injected plastic during molding requires a thicker section to allow for complete filling. Consequently, the resulting filling pattern will form a meld line through the thinnest section. As the thickness in the tapered section 26 increases, the flow front of the plastic will move uniformly to the outside rim structure 12 of the closure 10. Predictively, the last point to fill in a mold for making a closure 10 according to the present invention would be the area of the rim structure 12 in line with the tapered sections 26. Appropriate venting can be placed on the mold in these areas.

The closure 10 of the present invention may be utilized in a wide variety of containers such as, for example, paint cans, spackling buckets, coffee cans, margarine and butter tops. The specific thicknesses utilized may vary depending on the specific material and lid diameter for any specific closure 10.

It will be apparent to those of ordinary skill in the art that various modifications may be made to the present invention without departing from the spirit and scope thereof. Consequently, the scope of the present invention is intended to be defined by the appended claims.

What is claimed is:

1. A molded plastic closure comprising a perimeter rim structure with a center panel surrounded by and connected to said rim structure, said center panel including a plurality of substantially uniform thickness sectors and a plurality of substantially tapered thickness sectors, each of said sectors being defined by two radii extending from a center of said center panel outwards and at least one arc therebetween.

2. The closure of claim 1 further comprising a peripheral rim extending from an upper surface of said center panel adjacent said rim structure.

3. The closure of claim 2 wherein said upper surface of said center panel is substantially planar radially within said peripheral rim.

4. The closure of claim 1 wherein said rim structure includes a circular flange extending substantially perpendicular to said center panel from a lower surface of said center panel, and an inwardly extending locking projection on a lower portion of said flange spaced from said center panel.

5. The closure of claim 1 wherein said center panel further includes a circular center gate section, wherein said uniform thickness sectors and said tapered sectors extend from said center gate section.

6. The closure of claim 5 wherein said center gate section is substantially uniform in thickness.

7. The closure of claim 5 wherein each said tapered sector extends from said center gate section to said rim structure.

8. The closure of claim 7 wherein the thickness of each said tapered sector adjacent said center gate section is about one third of the thickness of said tapered sector adjacent said rim structure.

9. The closure of claim 8 wherein each said tapered sector tapers from a thickness of about 0.018" to about 0.006", and wherein each said uniform thickness sector has a thickness of about 0.018".

10. The closure of claim 8 wherein each said uniform thickness sector has a thickness substantially equal to said thickness of each said tapered section adjacent said rim structure.

11. The closure of claim 1 wherein each said tapered sector is spaced between two said uniform thickness sectors.

12. The closure of claim 11 wherein each said uniform thickness sector is in an arc of about 25 degrees.

13. An injection molded one-piece, integral closure, said closure comprising:

a center gate section of substantially uniform thickness a plurality of sectors, each of said sectors being defined by two radii extending from a center of said center panel outwards and at least one arc therebetween;

at least one sector of said plurality of sectors having a substantially uniform thickness extending from said center gate section; and at least one sector of said plurality of sectors extending from said center section and having a thickness increasing in a direction away from said center gate section.

14. The closure of claim 13 further including a peripheral rim attached to and surrounding said sectors.

15. The closure of claim 14 wherein each said uniform thickness sector has a thickness substantially equal to said thickness of each said increasing thickness sector adjacent said rim structure.

16. The closure of claim 15 wherein the thickness of each said increasing thickness sector adjacent said center gate section is about one third of the thickness of said increasing thickness sector adjacent said rim structure.

17. The closure of claim 16 wherein each said increasing thickness sector is spaced between two said uniform thickness sectors.

18. The closure of claim 17 wherein said sectors and said center gate section form a center panel and further including a peripheral rim extending from an upper surface of said center panel adjacent said rim structure.

19. The closure of claim 18 wherein said upper surface of said center panel is substantially planar radially within said peripheral rim.

20. The closure of claim 19 wherein said rim structure includes a circular flange extending substantially perpendicular to said center panel from a lower surface of said center panel, and an inwardly extending locking projection on a lower portion of said flange spaced from said center panel.

* * * * *